US009631633B2

(12) United States Patent
Manninen

(10) Patent No.: US 9,631,633 B2
(45) Date of Patent: Apr. 25, 2017

(54) ROTOR FOR A CENTRIFUGAL FLOW MACHINE AND A CENTRIFUGAL FLOW MACHINE

(71) Applicant: Sulzer Management AG, Winterthur (CH)

(72) Inventor: Heikki Manninen, Mänttä (FI)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 14/899,920

(22) PCT Filed: Jun. 16, 2014

(86) PCT No.: PCT/EP2014/062489
§ 371 (c)(1),
(2) Date: Dec. 18, 2015

(87) PCT Pub. No.: WO2015/000677
PCT Pub. Date: Jan. 8, 2015

(65) Prior Publication Data

US 2016/0138604 A1 May 19, 2016

(30) Foreign Application Priority Data

Jul. 2, 2013 (EP) ..... 13174714

(51) Int. Cl.
*F04D 29/22* (2006.01)
*F04D 1/00* (2006.01)
(Continued)

(52) U.S. Cl.
CPC ..... *F04D 29/2233* (2013.01); *F04D 1/00* (2013.01); *F04D 17/08* (2013.01); *F04D 29/2266* (2013.01); *F04D 29/242* (2013.01); *F04D 29/245* (2013.01); *F04D 29/281* (2013.01); *F04D 29/126* (2013.01); *F04D 29/28* (2013.01)

(58) Field of Classification Search
CPC ..... F04D 1/00; F04D 17/08; F04D 29/2233; F04D 29/242; F04D 29/2266; F04D 29/245; F04D 29/281; F04D 29/28; F04D 29/126; F04D 29/128
See application file for complete search history.

(56) References Cited

U.S. PATENT DOCUMENTS 2,117,011 A 5/1938 Pratt
3,481,273 A 12/1969 Werra
(Continued)

FOREIGN PATENT DOCUMENTS

EP 0834326 A2 4/1998
GB 912518 A 12/1962
GB 1055621 A 1/1967

OTHER PUBLICATIONS

International Search Report and Written Opinion issued Aug. 4, 2014 in PCT/EP2014/062489, filed Jun. 16, 2014.

*Primary Examiner* — Richard Edgar
*Assistant Examiner* — Jesse Prager
(74) *Attorney, Agent, or Firm* — Global IP Counselors, LLP

(57) ABSTRACT

A rotor structure for a centrifugal flow machine includes working vanes attached to the hub of the rotor without any support disc or shroud. Additionally, the vane has a device for efficiently flushing the sealing chamber behind the rotor.

18 Claims, 3 Drawing Sheets

(51) Int. Cl.

| | |
|---|---|
| ***F04D 17/08*** | (2006.01) |
| ***F04D 29/24*** | (2006.01) |
| ***F04D 29/28*** | (2006.01) |
| *F04D 29/12* | (2006.01) |

(56) References Cited

U.S. PATENT DOCUMENTS

| | | | | |
|---|---|---|---|---|
| 4,063,849 | A | 12/1977 | Modianos | |
| 5,489,187 | A * | 2/1996 | Ray | B01F 3/04617 415/111 |
| 5,591,001 | A * | 1/1997 | Ray | B01F 3/04617 261/34.1 |
| 7,607,884 | B2 * | 10/2009 | Cohen | F04D 7/045 415/111 |
| 2004/0136826 | A1 * | 7/2004 | Britt | F04D 29/128 415/206 |

* cited by examiner

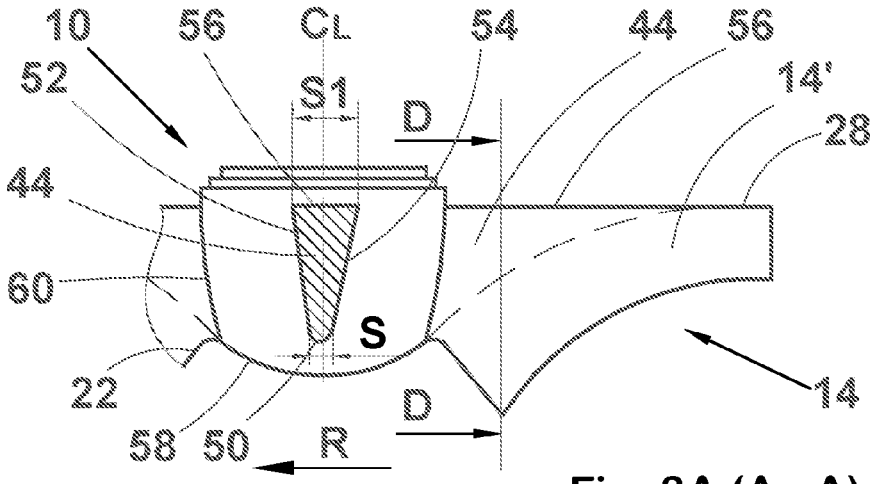
Fig. 3A (A - A)
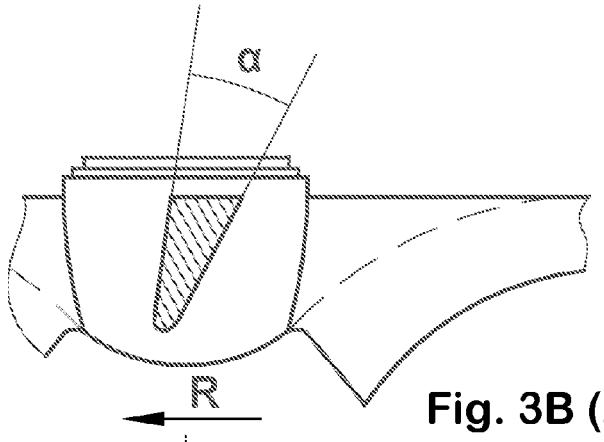
Fig. 3B (A - A)
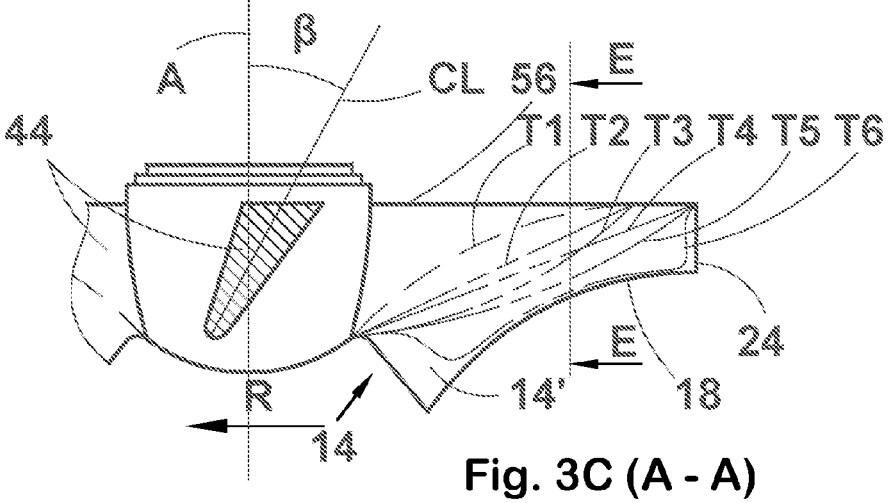
Fig. 3C (A - A)

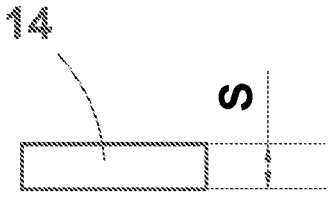
Fig. 4 (B - B)
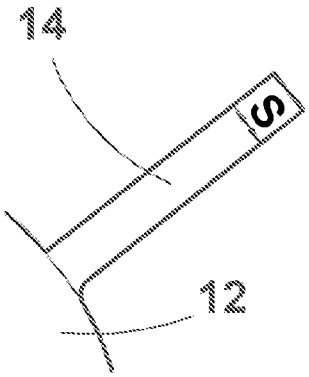
Fig. 5 (C - C)
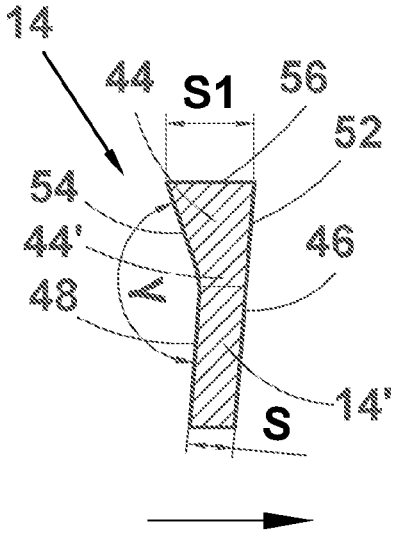
Fig. 6A (D - D)
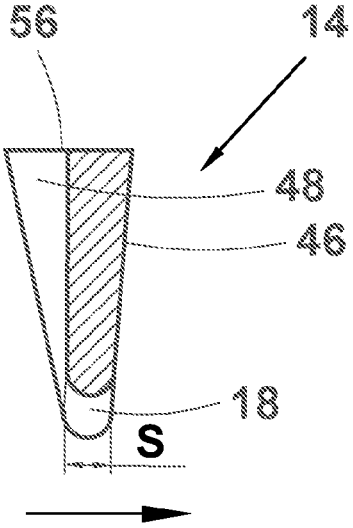
Fig. 6B (E - E)
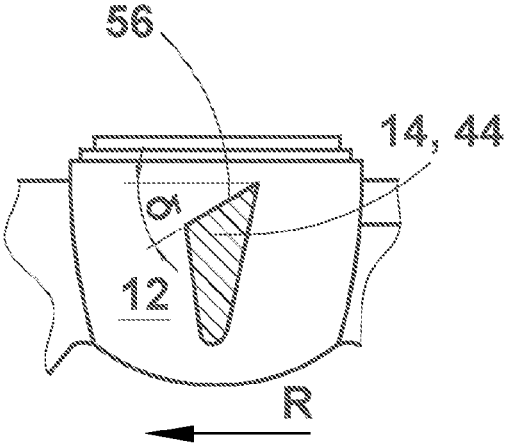
Fig. 7 (A - A)

ROTOR FOR A CENTRIFUGAL FLOW MACHINE AND A CENTRIFUGAL FLOW MACHINE

CROSS-REFERENCE APPLICATION

This application is a U.S. National Stage Application of International Application No. PCT/EP2014/062489, filed Jun. 16, 2014, which claims priority to European Application No. 13174714.9, filed Jul. 2, 2013, the contents of each of which is hereby incorporated herein by reference.

BACKGROUND

Field of Invention

The present invention relates to a rotor for a centrifugal flow machine and a centrifugal flow machine. The present invention is especially applicable in designing impellers for centrifugal pumps and blowers.

Background Information

In the following description of prior art and the present invention, a centrifugal pump has been used as an example of a centrifugal flow machine, and an impeller as an example of a rotor of a centrifugal flow machine. However, it must be borne in mind that the present invention may be used in connection with any centrifugal flow machine i.e. any pumping or blowing apparatus having a rotary shaft, which has a rotor coupled thereto. Thus the centrifugal flow machine includes, in addition to centrifugal pumps, also centrifugal blowers, just to name a couple of most preferred alternatives.

Nowadays centrifugal pumps or flow machines may be categorized by the type of their rotor into centrifugal flow machines having closed, semi-open or fully open impellers. When speaking in brief and somewhat simplified manner a closed impeller is an impeller, whose working vanes are at their both radially or spirally extending sides or edges covered by a shroud, a semi-open impeller has the shroud only at one radially or spirally extending side or edge of the working vanes and the open impeller does not have a shroud at all.

Traditionally centrifugal pumps have used as their shaft sealing a packing box-type sealing. However, nowadays various slide ring seals have been designed to perform the same task and occupy the same position at the rear side of the impeller. Additionally, so called dynamic seals are in use, too. In dynamic seals the sealing is taken care of by a repeller when the pump is running and a static seal when the pump is not running. However, the use of the slide ring seal has got popular and its popularity will increase in the future while the users are moving towards pumps having variable speed drives. The construction of present impellers is not able to ensure safe use of a slide ring seal, as neither the cavity or space for the sealing nor the impeller has been designed such that the sealing would, in all operating conditions of a pump, be totally surrounded by the liquid to be pumped. Additionally, the various impeller structures have to be chosen in accordance with the liquid to be pumped, and the user cannot be sure that the sealing works in a reliable manner in all possible operating conditions. The impellers comprise structures, which make the impellers hard to manufacture and decrease the efficiency ratio of the impeller. Furthermore, balancing arrangements in use at present for balancing the axial forces across the impeller waste a significant part of the efficiency ratio of the impeller.

In the following various problems concerning different impeller structures will be discussed.

EP-A2-2236836 may be mentioned as an example of a document discussing a closed impeller of a centrifugal pump. As a first problem, especially concerning small pumps, of a closed impeller, where the working vanes of the impeller are situated between two shrouds, i.e. a rear and a front shroud, the shrouds take a significant part of the cross-sectional flow area of the flow channel (between the front and rear walls of the volute).

If the impeller includes a sealing ring at the rear side of the rear shroud (the shroud farther away from the inlet of the pump), there is normally a flow connection by balancing holes through the rear shroud to the front side of the rear shroud, i.e. to the area of the working vanes. In this construction there is a flow of liquid to be pumped from the pressure side of the impeller (area at or close to the trailing edges of the working vanes) to the sealing cavity and from there via the balancing holes back to the suction side of the impeller (area at or close to the leading edges of the working vanes). The sealing space forms a chamber, which cannot be kept clean but solid matter suspended in the liquid to be pumped is received and collected in the chamber. The axial force acting on the impeller may be relatively efficiently balanced by the balancing holes.

If the impeller includes rear vanes on the rear surface (facing away from the pump inlet) of the rear shroud the impeller may be designed with or without balancing holes.

If such an impeller with rear vanes does not have balancing holes through the rear shroud, the sealing chamber is a dead-end chamber, where the liquid is not able to change and usually gas contained in the liquid is collected in the sealing chamber resulting in that the sealing is running dry and pressure is decreasing below boiling point due to the efficient work of the rear vanes. The axial force is high, when the pump is run outside its best efficiency point.

If the impeller with rear vanes has balancing holes through its rear shroud liquid is flowing to the rear side of the rear shroud via the balancing holes. This construction ensures better liquid circulation and the axial force is balanced better on a wider production range.

A semi-open impeller, sometimes also called as a half-open or a semi-closed impeller, has been discussed, as an example, in U.S. Pat. No. 5,385,442. The semi-open impeller has a flow space between the rear shroud of the impeller and a separate static rear wall, the rear wall oftentimes being a part of a casing cover of a centrifugal flow machine. In this kind of a centrifugal flow machine the rear shroud takes a significant part of the cross sectional flow area in the flow channel, too.

The semi-open impeller may have rear vanes so that the pressure acting on the rear wall is balanced close to the pressure on the front side of the shroud. However, it should be understood that only at a single operating point of the pump the axial force is fully balanced. If the semi-open impeller includes balancing holes, the same problems may be seen as with a closed impeller. And if the semi-open impeller is does not include balancing holes, the same problems may be seen as with a closed impeller, too.

If a semi-open impeller does not include rear vanes, the axial force cannot be balanced, but several bearings have to be taken in use for absorbing the axial force. If this construction has no balancing holes through the shroud, the sealing chamber is a dead-end chamber, where the liquid is not able to change and usually gas contained in the liquid is collected in the sealing chamber resulting in that the sealing is running dry. The axial force is very high. If the shroud of a semi-open impeller includes balancing holes, the sealing chamber is still a dead-end chamber, where the liquid is not able to change and usually gas contained in the liquid is collected in the sealing chamber resulting in that the sealing is running dry. The axial force is high but somewhat lower than in the construction without balancing holes.

If the semi-open impeller includes, at its rear side, a sealing ring the sealing chamber has a fluid connection to the front side of the shroud, i.e. to the suction side of the impeller, via the balancing holes. In this type of a construction, the liquid to be pumped flows from the pressure side of the impeller (at the impeller outer circumference) to the sealing chamber and therefrom via the balancing holes to the suction side of the impeller (at the inner circumference of the working vanes of the impeller). In this case, the sealing chamber is a cavity that is not able to stay clean but solids suspended in the liquid to be pumped are received and collected in the chamber. The axial force is relatively well balanced by the discussed structure.

An open impeller is an impeller where a flow channel for liquid is disposed between the impeller support disc, front wall of the volute and the static rear wall thereof. As an example of a document discussing an open impeller U.S. Pat. No. 3,964,840 may be mentioned. The impeller support disc is, in fact, a rear shroud of an impeller having a reduced diameter such that the support disc extends outwardly to a radial distance from the impeller hub and gives support to the working vanes. Normally, due to the presence of the support disc the working vanes may be made relatively thin at their root area, i.e. at their ends where they connect to the hub.

The construction of the open impeller may comprise a support disc without balancing holes. In such a construction the sealing chamber is a dead-end chamber, where the liquid is not able to change and usually gas contained in the liquid is collected in the sealing chamber resulting in that the sealing is running dry. The axial force is, however, rather well balanced.

The construction of the open impeller may, as a variant, comprise a support disc with balancing holes. In this construction liquid to be pumped flows via the balancing holes to the rear side of the support disc. The construction ensures better liquid circulation and the axial force is rather well balanced at a relatively wide production range.

U.S. Pat. No. 3,481,273 discusses another type of an open impeller where the working vanes have been attached to the hub by root portions such that there are, between the working vanes, open areas having the same diameter as the hub surface, i.e. there is no support disc for attaching the working vanes to the hub.

In brief, the various traditional rotor or impeller structures of centrifugal flow machines have a few drawbacks, which complicate the manufacture and use of the flow machines, reduce their efficiency ratio and risk the reliable and trouble-free operation of the shaft sealing.

Firstly, the closed and semi-open impeller have relatively high friction losses and limited cross sectional flow area due to the presence of the at least one shroud. Also, the efficiency ratio is affected negatively by the existence of the shroud/s.

Secondly, the existence of an axial force subjected to the impeller or rotor requires the use of larger or stronger bearings.

Thirdly, the present prior art impeller structures do not, not even the open impeller, ensure sufficient and reliable flushing of the sealing chamber.

SUMMARY

Thus, an object of the present invention is to eliminate at least one of the above mentioned drawbacks or problems by a novel rotor structure of a centrifugal flow machine.

Another object of the present invention is to develop a novel rotor structure improving the efficiency ratio of the centrifugal flow machine.

A further object of the present invention is to suggest a novel rotor structure minimizing the axial force across the rotor and thus enabling the application of small bearings for supporting the shaft of the centrifugal flow machine.

A still further object of the present invention is to suggest a novel rotor structure ensuring efficient flushing of the sealing chamber and, as a result, ensuring long-lasting and trouble-free operation of the shaft sealing.

A yet further object of the present invention is to suggest a novel rotor structure introducing a new working vane geometry or cross section design for a working vane such that the working vanes are light but sturdy.

The characterizing features of the rotor for a centrifugal flow machine in accordance with the present invention by which at least one of the above discussed problems are solved become apparent from the appended claims.

The present invention brings about a number of advantages, for instance

- By removing the shroud/s of the closed or semi-open rotors, and a support disc of an open rotor, a fully open rotor is created. The flow channel (from the inlet to the outlet) of such a centrifugal flow machine operates much more efficiently than that in traditional pumps, as the friction losses are reduced whereby the efficiency rate increases in spite of the fact that leakage round the side edges of the working vanes is somewhat increased.
- Since the rotor is fully open and the pressures in both axial sides of the rotor are equal there is no need for any means or device (balancing holes, rear vanes) for balancing the axial force. This results in better efficiency ratio and possibility to use smaller bearings.
- By removing the support disc or support ribs arranged to the rear side of the working vanes often used in traditional open rotors a free access to the sealing chamber is opened. To maintain the sealing chamber in flow communication with the main flow of the rotor in all operating conditions of the centrifugal flow machine the diameter of the hub of the rotor is the same or smaller than that of the rotary sealing member.
- The flushing of the sealing chamber may be improved by designing the cross section of the working vane at the root area of the vane such that the vane pumps fresh fluid to be pumped towards the sealing chamber, whereby a fluid circulation is created and the fluid present in the sealing chamber is pushed back to the main flow of the rotor.
- The novel vane profile, i.e. the cross section of the working vane does not need a support disc, and it is cost-effective to manufacture, as material is used only where it is really needed. The manufacture of the rotor may be easily performed by casting or machining as the structure is open and sturdy.

As to the above listed advantages it should be understood that each embodiment of the invention may not lead to each and every advantage, but just a few of those.

BRIEF DESCRIPTION OF THE DRAWINGS

The invention will be explained in more detail hereinafter with reference to the drawings.

FIG. 3A illustrates a cross sectional view A-A of the rotor of FIG. 1 showing an exemplary shape of a root portion of a working vane, FIG. 3B illustrates a cross sectional view A-A of the rotor of FIG. 1 showing another exemplary shape of a root portion of a working vane, FIG. 3C illustrates a cross sectional view A-A of the rotor of FIG. 1 showing yet another exemplary shape of a root portion of a working vane, FIG. 4 illustrates in a front view B-B of FIG. 2 the working vane at its trailing edge area, FIG. 5 illustrates in a front view C-C of FIG. 2 the working vane at its leading edge area, FIG. 6A illustrates a cross section D-D of FIG. 3A, i.e. a cross section of a working vane in a plane perpendicular to the leading surface of the working vane and parallel with the axis of the rotor, FIG. 6B illustrates a cross section E-E of FIG. 3C, i.e. a cross section of a working vane in a plane perpendicular to the leading surface of the working vane and parallel with the axis of the rotor, and FIG. 7 illustrates yet another cross sectional view A-A of the rotor of FIG. 1 showing a preferred orientation of the rear face of the working vane.

DETAILED DESCRIPTION OF THE EMBODIMENTS

Figure 1:
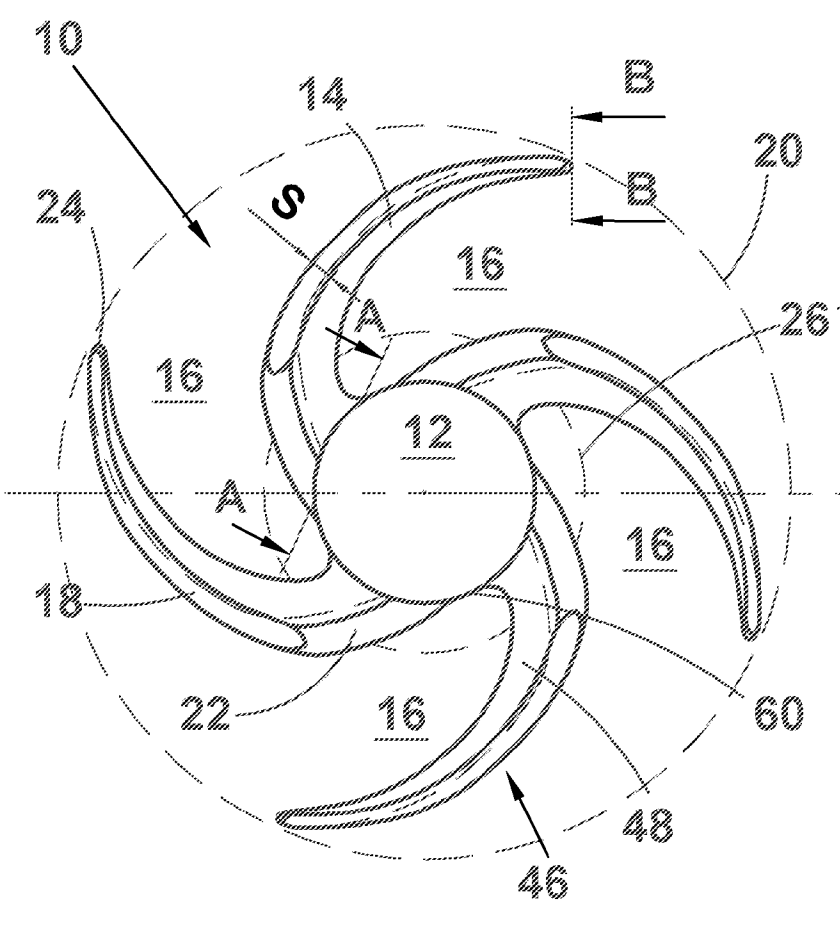
FIG. 1 illustrates schematically a front view of the rotor in accordance with a preferred embodiment of the present invention.

FIG. 1 illustrates a front view of a rotor in accordance with a preferred embodiment of the present invention. The rotor of FIG. 1 is especially applicable as an impeller of a centrifugal pump. The rotor 10 comprises a hub 12 and four working vanes 14 extending outwardly therefrom. The rotor vanes 14 leave flow chambers 16 there between via which the fluid advances from the inlet opening of a flow machine to the outlet opening thereof. It is an essential feature of the present invention that the flow chambers 18 are open all the way from the outer periphery or circumference (broken circle 20) of the rotor 10 to the outer surface 60 of the hub 12. Preferably, but not necessarily, the outer surface of the hub is a rotationally symmetrical (for instance conical or paraboloidal) surface. In other words, the open impeller of the present invention does not have any support disc extending from the hub for supporting the working vanes. Thus, the fluid has free and open access from the inlet of the flow machine, i.e. the front side of the rotor, to the sealing chamber, i.e. the rear side of the rotor, along the surface of the hub 12. Naturally it is clear that the number of working vanes 14 is by no means limited to four but may, in fact, be one or more. Also, it is clear that the working vane/s 14 may not only be curved and extend outwardly from the hub 12 spirally, as shown in FIG. 1, but it/they may be straight and extend from the hub 12 radially or in a direction inclined to the radial direction. FIG. 1 shows also the front edge 18 of the working vane 14 having a thickness S. The working vanes 14 have a leading edge 22, a trailing edge 24 and a rear edge or rear face (facing away from the inlet of the flow machine). The broken circle 26 illustrates the outer perimeter of the sealing cavity in the sealing housing of the flow machine 10 (better visible in FIG. 2) in relation to the hub 12 to clarify the open flow area from the inlet of the flow machine to the sealing chamber at the rear side of the rotor.

Figure 2:
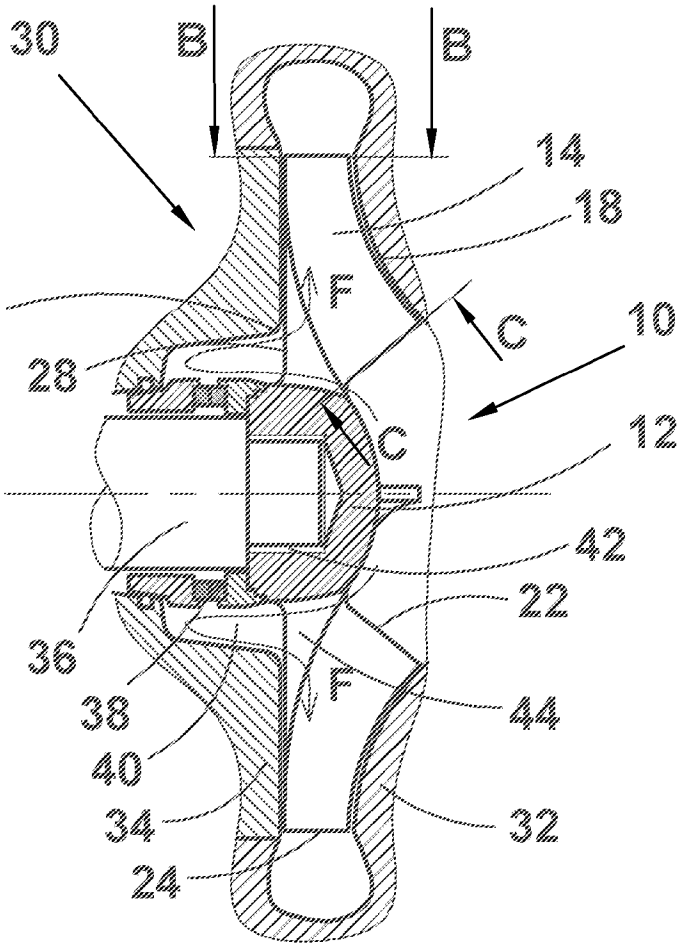
FIG. 2 illustrates a partial axial cross section of a centrifugal flow machine comprising a rotor of FIG. 1.

FIG. 2 illustrates a partial axial cross section of a centrifugal flow machine 30 comprising the rotor 10 of FIG. 1. The centrifugal flow machine 10 comprises a volute casing 32 having an inlet duct with an inlet opening (not shown) at the right hand side in FIG. 2, and an outlet duct with an outlet opening (not shown). The volute casing 32 is attached to the casing cover 34. The volute casing 32 and the casing cover 34 leave therebetween a cavity called volute for housing the rotor 10, or impeller. FIG. 2 also shows the working vanes 14 of the rotor 10 and the front edges 18, rear edges or faces 28, leading edges 22 and trailing edges 24 of the working vanes 14. The casing cover 34 not only houses the bearings (not shown) that support the shaft 36 of the centrifugal flow machine, but also houses the shaft sealing 38 of the centrifugal flow machine 30.

In this embodiment of the centrifugal flow machine, the shaft sealing 38 is, as an example only, formed of a slide ring seal. The slide ring seal has a stationary sealing member and a rotary sealing member, both having specific slide rings that are in continuous contact with each other. The left hand side sealing member, i.e. the stationary one, is secured non-rotatably to the casing cover 34 and sealed thereto by an O-ring. The right hand side sealing member is secured or coupled to the rear end (facing away from the inlet opening of the centrifugal flow machine) of the hub 12 of the rotor 10 such that it rotates together with the rotor 10. The shaft sealing 38, which may, in fact, be of any type used for sealing the shaft 36 of a centrifugal flow machine 30, is surrounded by a so called sealing chamber 40 having an outer perimeter 26 and being arranged in the casing cover 34. Since the fluid to be pumped contains very often solid impurities, the impurities inevitably enter the sealing chamber 40, too. Depending on the type of sealing 38 used the solids collected in the chamber 40 and on the sealing 38 affect more or less on the performance and/or wear of the sealing 38. Therefore, the sealing chamber 40 has to be flushed with the fluid to be pumped as shown by arrows F.

FIG. 2 also shows the hub 12 with a means (or device) for coupling the rotor 10 on the shaft 36. The device may be, as shown, a threaded hole 42 in the hub 12. The device may also be a central hole through the hub so that the shaft may be pushed in the hole and the rotor secured to the end of the shaft with a nut. The latter option may also use a key or a non-round cross section of the shaft and the hole for preventing the rotation of the rotor on the shaft.

As discussed earlier in this specification, most of, or in practice all, the known impeller or rotor structures have problems when both balancing the axial forces across the impeller and flushing the sealing chamber.

A part of the problems are solved and a part of the disadvantages are removed by removing the support disc of the traditional open impellers and by designing the hub area of the rotor 10 in a novel and inventive manner. It is clear that when the support disc is removed the construction of the working vane 14 itself has to be modified such that the vane 14 is able to carry all loads subjected thereto without any risk of breakage. Therefore, at least the root area (shown as a substantially trapezoidal or triangular area 44 in FIGS. 3A-3C) of the working vane 14 has been re-designed to be sturdier than before. Another part of the problems are solved by designing the working vane 14 and the hub 12 of the rotor 10 such that effective flushing of the sealing chamber 40 (shown in FIG. 1, too, with a broken circle 26) is ensured in all operating conditions of the centrifugal flow machine 30.

The working vanes 14 of the rotor 10 shown in the embodiment of FIGS. 1 and 2 are formed of a root portion 44 and a vane portion. The main and, in fact, only task of the vane portion is to pump the fluid from the inlet to the outlet of the centrifugal flow machine 30. The root portion 44 of a working vane 14 is used to fasten the vane portion of the working vane 14 to the hub 12, and to assist in pumping the fluid. In other words, the root portion 44 has taken over the task of the support disc of a prior art open impeller, i.e. it supports the vane portion for a significant part of its extension. However, the root portions 44 of the working vanes 14 do not form a disc type support but are separate and working vane specific members individually extending from the surface 60 of the hub 12 of the rotor 10 such that in the flow chambers 16 between the working vanes 14 the surface 60 of the hub 12 remains free and open.

The working vanes 14 have a leading edge 22 receiving fluid from the inlet opening of the centrifugal flow machine 30 and a trailing edge 24 discharging the fluid to the outlet opening of the centrifugal flow machine 30. The working vanes 14 also have a leading surface 46 pushing the fluid forward towards the outlet opening and a trailing surface 48 on the opposite side of the working vane 14. Furthermore, the working vanes have a front edge 18 facing the volute casing 32 and a rear edge or face 28 facing the casing cover 34. Depending on the application the edges, i.e. the leading, trailing, front and rear edges of the working vanes, may be rectangular or rounded. For instance, when pumping fibrous slurries the leading edge 22 as well as the front 18 and rear edges 28 have to be rounded for preventing fibers from adhering to the edges. Additionally, the leading edge 22 may be sharpened, i.e. more or less wedge shaped (but still rounded), too, for improving the effect of drawing fluid from the inlet opening of the flow machine to the effective area of the working vanes 14.

FIGS. 3A-3C illustrate a partial cross section A-A of the rotor of FIG. 1 such that a working vane has been cut away. The arrow R shows the direction of rotation of the rotor 10, or rather the direction of movement of the working vane, which has been cut away. FIGS. 3A-3C show that the root portion 44 of a working vane 14 has a mainly trapezoidal or triangular cross section. The root portion 44 has a rounded front edge 50, two side faces; a leading side face 52 and a trailing side face 54, and a rear face 56. The front edge 50 may be considered either as the tip of the triangle, or as the shortest side of a trapezoid, which has, after rounding, a thickness S, which, in accordance with an embodiment of the present invention, corresponds to the thickness of the vane portion of the working vane 14. More generally speaking the thickness S of the front edge 50 after rounding corresponds to the thickness of the vane portion 14' at a position where the vane portion joins the root portion 44. By the thickness S of a working vane is, in this specification, generally understood the average Z-direction dimension measured in a direction perpendicular to the centreline CL of a working vane at the vane portion 14' thereof. By using the average dimension as thickness S local changes in the thickness of the vane, like various rounded, bulb-shaped or tapered areas at the vane edges etc., have been taken into account. When comparing the cross section 44 to the working vane 14 to the right it may be understood that the front edge 50 of the root portion 44 is, in fact, a mere corner between the frontal surface 58 of the hub 12 and the leading edge 22 of the vane portion 14' of the working vane 14. This is, preferably, but not necessarily, the only position where the root portion 44 itself may be considered receiving the fluid so that the fluid has not before been in contact with the vane portion 14' of the working vane 14. The radius of the rounding at the front edge 50 of the root portion 44 as well as at the leading edge of the working vane 14 is preferably, but not necessarily, between –V..*S-*S. The cross section of the root portion 44 of the working vane has a centreline CL, which is, in this exemplary case, substantially parallel with the axis of the rotor 10 and runs via the front edge 50 of the root portion 44. The width or thickness 51 of the root portion at the rear face 56 (close to the hub 12 and measured in a direction perpendicular to the centreline CL of the working vane as shown exemplarily in FIG. 3*a*) is of the order of 2*S . . . 5*S depending on the size of the rotor, i.e. with small rotors the width may be closer to 2*S and with large rotors closer to 5*S.

The leading side face 52 and the trailing side face 54 of the root portion 44 depart from one another, when moving from the front edge 50 towards the rear face 56 of the working vane, at an angle α (shown in FIG. 3B, the angle α being preferably between 5 and 45 degrees, whereby the thickness 51 represents the largest thickness dimension of the root portion of the working vane. If one or both side faces 52 and 54 are curved (in the cross section shown in FIGS. 3A, 3B, 3C and 7) the inclination angle α is determined by using the tangent of the curved side face to represent the inclination of the curved side face. The rear face 56 of the root portion 44 of the working vane 14 has been shown as a plane at right angles to the axis of the rotor 10. The rear face may, naturally, be curved, and also inclined in case the working vanes are inclined backward or forward. But in all these cases the rear surface extends in substantially circumferential direction. This construction ensures maximal strength for the working vane. If the rear face of the root portion were inclined significantly from its circumferential direction it would mean removal of material from the root portion and a weaker root portion, unless the vane width is increased. However, such a construction has its own advantages as will be explained later on. As to the rear face 56 of the working vane 14 it has to be understood that, in accordance with a preferred additional embodiment of the present invention, it transforms gradually, when moving towards the outer circumference of the rotor 10, i.e. at least at the outer circumference, to the rear edge 28 of the working vane 14. Preferably, but not necessarily, the vane portion 14' has a thickness S at the trailing edge thereof. The rear edge 28 of the working vane 14 may be rounded in the manner of the leading edge 22 or it may be rectangular, for instance.

FIG. 3C discusses in more detail the inclination of the centreline CL of the root portion 44 and the actual shaping of the working vane 14 between the root portion cross section shown in FIGS. 3A-3C and the trailing edge 24 of the working vane 14. The inclination of the centreline CL of the root portion 44 from the direction of the axis A of the rotor is shown by angle β. In accordance with performed experiments the angle may vary at least between +/–45 degrees.

FIG. 3C discusses also the actual shaping of the working vane 14 between the root portion cross section shown in FIGS. 3A-3C and the trailing edge 24 of the working vane 14. FIG. 3C illustrates various preferred additional embodiments of the present invention by way of six broken transitional curves T1, T2, . . . T6 on the trailing surface of the working vane 14 where the thickness of the working vane 14 starts growing from the thickness of the vane portion 14' to the thickness of the root portion 44 at the rear face 56 thereof. In other words, in FIG. 3C the part of the working vane 14, which is below the curves T1, T2, . . . T6, i.e. between the curves T1, T2, . . . T6 and the front edge 18 of the working vane 14, has a, preferably but not necessarily, substantially constant thickness S and the part above the curves T1, T2, . . . T6, i.e. between the curves and the rear edge or rear face 56 of the working vane 14, has an increased thickness. As shown in FIG. 3C the root portion 44, i.e. the thickened part of the working vane 14 at the rear edge 28 or rear face 56 of the working vane 14 may terminate either at the trailing edge 24 of the working vane 14 (curves T4-T6) or at a certain distance from the axis A of the rotor 10 (curves T1-T3). Performed experiments have shown that the root portion 44, i.e. the thickened part of the working vane, should extend at its rear edge 28 or rear face 56 to a distance of between 0.5 to 1.0*r from the axis A of the rotor 10 where r is the radius of the rotor 10. In accordance with an optional embodiment of the present invention the thickness of the root portion 44 at the rear face 56 thereof decreases gradually from the hub 12 to the outer end of the root portion 44 such that the thickness of the root portion at its outer end equals to the thickness of the vane portion.

FIG. 4 illustrates an end view B-B at the trailing edge area of the working vane of FIG. 2. In other words, at the trailing edge area of the working vane 14 the vane has a thickness S and the cross section of the working vane is, in accordance with one variant of the present invention, rectangular. In accordance with another variant of the present invention the cross section of the working vane 14 at the trailing edge area is basically rectangular but includes at least one rounded side edge. In accordance with yet another variant of the present invention the cross section of the working vane at the trailing edge area is curved with rectangular side edges. And in accordance with still another variant of the present invention the cross section of the working vane at the trailing edge area is curved with at least one rounded side edge.

FIG. 5 illustrates an end view C-C of the working vane of FIG. 2 at its leading edge area. In other words, at the leading edge area of the working vane 14 the vane has a thickness S and the cross section of the working vane is, in accordance with one variant of the present invention, rectangular. In accordance with another variant of the present invention the cross section of the working vane at the leading edge area is basically rectangular but includes a rounded front edge. The radius of the rounding is preferably between –V..*S-*S. In accordance with yet another variant of the present invention the cross section of the working vane at the leading edge area is curved with a rectangular side edge. And in accordance with still another variant of the present invention the cross section of the working vane at the leading edge area is curved with a rounded side edge. As shown in FIG. 5 the working vane extends preferably substantially radially from the hub. However, it is also possible that the vane is somewhat inclined in either direction.

FIG. 6A illustrates a cross section D-D of the working vane of FIG. 3A in a plane perpendicular to the leading surface of the working vane and parallel with the axis of the rotor. Here the cross section of the working vane 14 is, in a way, formed of two parts, the root portion 44 and the actual vane portion 14' (the part having, for instance, a substantially constant thickness S). The root portion 44 has a front part 44', leading face 52, trailing face 54 and a rear face 56. The vane portion 14' of the working vane 14 has a leading surface 46, which, preferably but not necessarily, is integrated into the leading face 52 of the root portion 44, i.e. together they form the pumping or leading surface 46 (FIG. 1) of the working vane 14. The vane portion 14' further has a trailing surface 48 that, in this embodiment, forms a blunt angle y of 135-180 degrees with the trailing face 54 of the root portion 44. In fact, the main directions of the surface 48 and the face 54 for determining the blunt angle are viewed in a plane running perpendicular to the leading surface 46 of the working vane 14 and parallel with the axis of the rotor. The root portion 44 has a thickness S at its front part 44', i.e. equal to the thickness of the vane portion 14', and a thickness or width 51 at its rear face 56. The thickness S1 is greater than S, of the order of 2*S-5*S at an area close to the hub from where it decreases, when moving towards the trailing edge of the vane, to S.

FIG. 6B illustrates a cross section E-E of a working vane 14 of FIG. 3C in a plane perpendicular to the leading surface 46 of the working vane and parallel with the axis of the rotor and showing the working vane utilizing the transitional curve T6. FIG. 6B thus shows the cross section of the vane 14 farther away from the hub, as seen towards the hub and the vane 14 bent to a straight one. It may be seen that the utilization of curve T6 when forming the thickened part of the working vane 14 leads to a vane having, for the major part of the length of the vane, an increasing thickness from the front edge 18 towards the rear face 56 thereof. FIG. 6B shows how the pumping or leading surface 46 of the working vane has a certain inclination whereas the thickening at the trailing surface 48 changes the inclination of the trailing surface. This also means that the thickness of the vane at the rear surface 56 thereof increases when moving towards the hub. FIG. 6B also shows how the front edge 18 of a working vane 14 may be rounded if such is considered necessary, for instance, when using the flow machine for pumping fibrous slurries.

In other words, the working vane may have, for the major part of its length, a substantially trapezoidal, triangular or quadrilateral cross sectional basic shape. The sides of the trapezoid, triangle or quadrangle representing the front and rear surfaces 18, 28, 56 or faces or edges of the working vanes 14, all phrases used above, may be more or less rounded, and the other two sides representing the leading and trailing surfaces of the working vane may, not only be linear, but also curved. The above configuration of the vane cross section applies to both the root portion of the vane as shown in FIGS. 3A-3C and the vane at its full width shown in FIG. 6B.

A feature common to all cross sections of the working vane of the present invention is that the front edge 18 of the working vane 14 has a smaller thickness than the rear edge or face 56 of the working vane 14 for a substantial part of the length of the vane. As discussed earlier the increased thickness of the rear face of the working vane extends from the hub up to a distance of 0.5*r-1*r from the axis of the rotor.

The support feature of the root portion of the working vane has become evident from the above description. But the other feature of the root portion, i.e. its capability of effectively aid in flushing the sealing chamber has not been discussed in detail yet. By arranging the support of the working vanes by the root portion dedicated separately for each working vane in place of a continuous support disc of prior art, the entrance for the fluid to be pumped into the sealing chamber is ensured. In other words, by arranging the root portions of adjacent working vanes at a circumferential distance (maybe small, but still existing) from one other the flushing fluid may easily flow along the hub surface to the sealing chamber.

The rear face of the root portion of a working vane may, as an alternative to extending in circumferential direction or in a radial plane, if desired, be designed to have an angular inclination in relation to the circumferential direction, see FIG. 7. The rear face 56, thus, forms a sharp angle o with the circumferential direction, the angle o opening in the direction R of the rotation of the rotor. The rear face 56 is thus arranged in the angle o in relation to a radial plane. Such an inclined rear face 56 functions so that when the rotor receives fluid from the inlet of the centrifugal flow machine and the fluid enters the working vane area, i.e. on both sides of the working vane 14, the rear face 56 of the root portion 44 effectively pumps the fluid to the rear side of the rotor, i.e. into the sealing chamber. The same may be expressed also by saying that the rear face 56 of the root portion raises pressure in the sealing chamber whereby the fluid already present in the sealing chamber is forced back to the area of the working vanes. By ensuring this kind of continuous circulation in the sealing chamber any solids present in the fluid are not able to collect in the sealing chamber but are readily flushed away.

The above flushing feature may be further improved by dimensioning the hub and the sealing such that the diameter of the hub is equal or smaller than that of the sealing, whereby the fluid circulation takes place continuously from a smaller radius towards a larger one. This is especially important when then sealing used is a slide ring seal, which has to be kept clean. In such a case the diameter of the rotary sealing member coupled to the rotary hub of the rotor should be equal or larger than that of the hub. This ensures that the fluid that flows along the hub surface and between the root portions of the adjacent working vanes also flows along the outer circumference of the rotary sealing member without leaving any blind spots where solids from the fluid could settle.

As may be seen from the above description it has been possible to develop a rotor arrangement for a centrifugal flow machine, which rotor is very simple of its construction yet capable of performing its task as well as, or even better than, any other much more complicated rotor. The rotor of the present invention is less expensive to manufacture than the prior art rotors.

While the present invention has been herein described by way of examples in connection with what are at present considered to be the most preferred embodiments, it is to be understood that the invention is not limited to the disclosed embodiments, but is intended to cover various combinations and/or modifications of its features and other applications within the scope of the invention as defined in the appended claims.

The invention claimed is:

1. A rotor for a centrifugal flow machine, the rotor comprising:

a hub with an axis and device configured to couple the rotor, when in use, on a shaft of the flow machine including a sealing chamber; and at least one working vane extending outwardly from the hub, the working vane having a front edge, a leading edge, a trailing edge, a rear face, a leading surface and a trailing surface, the rear face, when in use, facing the sealing chamber, the working vane being formed of a root portion and a vane portion integrated to one another, the working vane being fastened to the hub solely by the root portion, the root portion having, when joined to the hub, a substantially trapezoidal or triangular cross section having sides representing a leading face, a trailing face, a rounded front edge between the leading face and the trailing face and the rear face opposite to the front edge of the root portion, the rear face of the at least one working vane forming a sharp angle with a circumferential direction, the sharp angle opening in a direction of rotation of the rotor for pumping fluid towards the sealing chamber for flushing the sealing chamber.

2. The rotor as recited in claim 1, wherein the rounded front edge has a thickness equal to a thickness of the vane portion at a position where the vane portion joins the root portion.

3. The rotor as recited in claim 2, wherein a thickness of the root portion is at the rear face adjacent the hub equal to 2*S-5*S, where S is an average thickness of the working vane at the vane portion.

4. The rotor as recited in claim 2, wherein the edges have a radius of ¼*S-½*S where S is an average thickness of the edge after rounding.

5. The rotor as recited in claim 1, wherein the leading face and the trailing face are arranged adjacent the hub at an angle between 5 and 45 degrees.

6. The rotor as recited in claim 1, wherein the root portion has a centerline running via the front edge and, at the rear face, a thickness measured in a direction perpendicular to the centerline of the root portion, the thickness representing a largest thickness dimension of the root portion of the working vane.

7. The rotor as recited in claim 6, wherein the centerline is arranged at an angle in relation to an axial direction, the angle being between +/−45 degrees.

8. The rotor as recited in claim 6, wherein a transitional line or curve is at the trailing surface of the working vane, a thickness of the working vane increasing from that at the transitional curve to that at the rear face of the working vane.

9. The rotor as recited in claim 8, wherein a blunt angle γ between 135-180 degrees is at the transitional line or curve between main directions of the trailing surface and the trailing face of the working vane in a plane perpendicular to the leading surface or the working vane and parallel with the axis of the rotor.

10. The rotor as recited in claim 1, wherein the working vane has a trapezoidal or triangular cross section in a plane perpendicular to the leading surface of the working vane and parallel with the axis of the rotor, the cross section having sides representing the front edge, a leading surface, a trailing surface and a rear face of the working vane.

11. The rotor as recited in claim 10, wherein at least one of the sides of the trapezoidal or triangular cross section representing the front edge, the leading edge of the working vane and the rear face is rounded.

12. The rotor as recited in claim 11, wherein the edges have a radius of ¼*S-½*S where S is an average thickness of the edge after rounding.

13. The rotor as recited in claim 10, wherein at least one of the sides of the trapezoidal or triangular cross section representing the leading surface and the trailing surface is curved.

14. The rotor as recited in claim 1, wherein the root portion of the working vane extends at the rear face at least to a distance of 0.5* the radius of the rotor from the axis of the rotor.

15. A centrifugal flow machine comprising the rotor of claim 1.

16. The centrifugal flow machine as recited in claim 15, wherein the centrifugal flow machine has a shaft sealing with a rotary sealing member coupled to the hub of the rotor, the rotary sealing member having a diameter and the hub having a diameter, and that the diameter of the hub is equal or smaller than that of the rotary sealing member.

17. The centrifugal flow machine as recited in claim 16, wherein the flow machine is a centrifugal pump or a blower.

18. The centrifugal flow machine as recited in claim 15, wherein the flow machine is a centrifugal pump or a blower.

* * * * *